United States Patent [19]

Shaw

[11] 4,019,214

[45] Apr. 26, 1977

[54] FLOATING PLATFORM

[76] Inventor: Stewart Shaw, 1000 Pleasant St., Stoughton, Mass. 02072

[22] Filed: Jan. 19, 1976

[21] Appl. No.: 649,982

[52] U.S. Cl. ..... 9/14; 9/8 R; 9/11 R; 9/311; 9/347; 272/1 B

[51] Int. Cl.[2] ..... B63C 9/00

[58] Field of Search ..... 9/11 R, 12, 14, 301, 9/311, 336, 347, 348, 8 R; 114/.5 F; 115/22.2, 22.3, 26.3; 272/1 B, 71, 32

[56] References Cited

UNITED STATES PATENTS

| | | | |
|---|---|---|---|
| 1,503,624 | 8/1924 | Bauman et al. | 9/11 R |
| 2,706,630 | 4/1955 | Cisne | 9/8 R |
| 2,814,057 | 11/1957 | Burns | 9/8 R |
| 3,092,858 | 6/1963 | Wallach | 272/1 B |
| 3,117,327 | 1/1964 | Mathew | 9/347 |
| 3,156,935 | 11/1964 | Long | 272/1 B |
| 3,307,208 | 3/1967 | Jacobson | 9/8 R |
| 3,373,991 | 3/1968 | Smalley | 272/71 |

*Primary Examiner*—Stephen G. Kunin
*Assistant Examiner*—Charles E. Frankfort
*Attorney, Agent, or Firm*—Allen D. Brufsky

[57] ABSTRACT

A floating standing platform used as a lifesaving device. The platform includes a planar deck which is submerged in a body of water and anchored in place. U-shaped handles extend from the bottom of the deck while upright supports extending from the top of the deck support a pair of buoyant floats. The platform is anchored at a convenient place where a swimmer or the like in distress can reach the floating platform, and grasp the handles to hoist himself upon the deck to await rescue. A safety belt can be attached to one of the floats to secure the victim to the platform.

4 Claims, 1 Drawing Figure

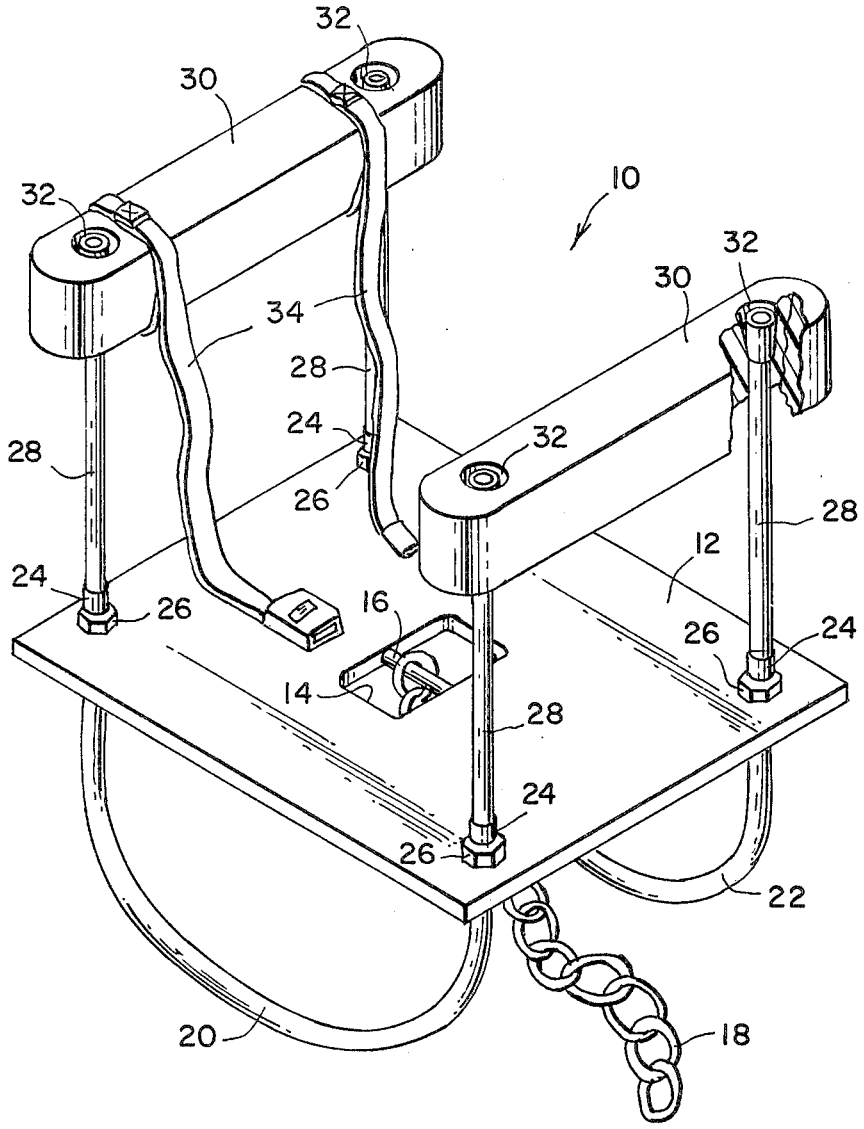
32
30
10
32
30
32
34
28
24
32
28
26
28
12
24
26
16
26
24
14
28
24
26
22
20
18

FLOATING PLATFORM

BACKGROUND OF THE INVENTION

This invention relates to a floating platform, and more particularly, a floating platform which is used as a lifesaving device.

Often, beach bathers wander too far from shore, panic or develop a muscle cramp and before help can arrive, drown. Similarly, many boating accidents result in drowning of the occupants of the boat when a boat overturns without proficient swimmers aboard. If a floating standing safety device was thrown overboard from the boat or such a device was strategically positioned at a predetermined distance from shore where it could be easily reached, many such deaths could be avoided.

SUMMARY OF THE INVENTION

Accordingly, it is an object of this invention to provide a floating standing platform which can be thrown overboard from a boat and anchored or anchored at a predetermined distance from the shoreline of a bathing beach to serve as a lifesaving support for persons who find themselves in distress in the water.

A further object of this invention is to provide a device of the character indicated with safety straps which would enable a lifeguard or other would-be rescuer to strap a victim to the platform until additional help could be mustered.

A still further object of this invention is to provide a device of the character indicated which is simple in construction durable and economical to manufacture.

The floating platform of the invention comprises a lifesaving device comprising:

- a substantially planar deck adapted to be submerged in a body of water,
- a pair of spaced, substantially U-shaped handles secured to the deck and extending downwardly from the bottom surface of the deck,
- an upright support connected to the end of the U-shaped handles extending upwardly from the top surface of the deck, and
- a pair of buoyant floats secured between adjacent upright supports.

BRIEF DESCRIPTION OF THE DRAWING

Further objects and advantages of the invention will become more apparent from the following specification and claims and from the accompanying drawing wherein:

The sole FIGURE is a perspective view of the floating platform of the present invention.

DETAILED DESCRIPTION OF THE PREFERRED EMBODIMENT

Referring now to the drawing in detail, the floating platform of the present invention is designated by the numeral 10. Platform 10 includes a plastic, e.g. "Plexi-Glass", non-corrosive planar surface or deck 12 which has a substantially rectangular configuration. Deck 12 has a central opening 14 therethrough provided with a transverse integral spindle 16. Secured to spindle 16 is an anchor chain 18 to which is attached a conventional boat anchor (not shown) or a tie-down device for securing deck 12 in place on the bottom or even, a pool floor.

A pair of spaced, substantially U-shaped tubes 20, 22 having externally threaded ends 24 are inserted through holes formed in the corners of planar deck 12 and secured to the deck 12 by nuts 26 threaded onto ends 24. An upright support tube 28 is inserted within each end 24 of the U-shaped tubes 20, 22; each tube 20, 22 and 28 are formed from non-corrosive metal, such as aluminum.

Mounted between each pair of upright support tubes 28 is a block 30 of buoyant material, such as polyurethane foam, polystyrene, or the like. Each block 30 has a pair of countersunk openings 32 which snuggly but slidably receive the upper ends of support tubes 28 are externally threaded to receive nuts to prevent removal blocks 30 from the support tubes 28. Secured to one of the buoyant blocks 30 are the two mating parts of a safety belt 34.

In use, platform 10 is thrown overborad from a boat with an anchor secured to anchor chain 18 or is tied to the sea bottom to secure it in place. Platform 10 will sink to the bottom surface of buoyant blocks 30, and therefore will float adjacent the surface of the water. Should the platform 10 be needed to rescue a person stranded in the water who can reach the platform, the person can grasp U-shaped tubes 20, 22 as handles and hoist himself onto deck 12 to await rescue. Safety belt 34 can be used to secure the person to the floating platform 10 so he is not washed away. Alternatively, a lifeguard could strap the victim to the floating standing platform deck 12 until additional help can be obtained.

It should be understood that the platform could be modified for use in a pool where drowning of stray pets is a significant problem in unattended pools. To effect such a modification, safety belt 34 and anchor chain 18 are removed from the device and buoyant blocks 30 slid and lowered towards deck 12 to vary the depth of the deck relative to the buoyant blocks 30. Should a pet inadvertently slip into the pool, it could swin onto deck 12 and eventually drift to the side of the pool where it could escape to safety.

I claim:

1. A lifesaving device comprising:

- a substantially planar deck adapted to be submerged in a body of water,
- a pair of spaced, substantially U-shaped handles secured to the deck and extending downwardly from the bottom surface of said deck,
- an upright support connected to the ends of each of said U-shaped handles extending upwardly from the top surfce of said deck,
- a pair of buoyant floats secured between adjacent upright supports,
- said deck including a centrally located opening,
- a spindle transversing said opening, and an anchor chain secured to said spindle.

2. A lifesaving device in accordance with claim 1 wherein said U-shaped handles are tubular, and said upright supports are inserted within the ends of said tubular handles.

3. A lifesaving device in accordance with claim 1 including a safety strap attached to one of said buoyant floats.

4. A lifesaving device in accordance with claim 1 wherein said buoyant floats are slidably adjustable on said upright supports to vary the distance between said floats and said deck.

* * * * *